US007802506B2

(12) United States Patent
Endo

(10) Patent No.: US 7,802,506 B2
(45) Date of Patent: Sep. 28, 2010

(54) UPPER TOOL DEVICE AND PUNCH THEREFOR

(75) Inventor: Shigeru Endo, Kanagawa (JP)

(73) Assignees: Amada Company, Limited, Kanagawa (JP); Aprotec Co., Ltd., Kanagawa (JP)

( * ) Notice: Subject to any disclaimer, the term of this patent is extended or adjusted under 35 U.S.C. 154(b) by 294 days.

(21) Appl. No.: 11/266,354

(22) Filed: Nov. 4, 2005

(65) Prior Publication Data

US 2007/0034069 A1 Feb. 15, 2007

(30) Foreign Application Priority Data

Jul. 4, 2005 (JP) ..... P2005-195092

(51) Int. Cl.
*B26F 1/14* (2006.01)

(52) U.S. Cl. ..... 83/140; 83/686

(58) Field of Classification Search ..... 83/136, 83/140, 697, 76.1, 651, 138, 139, 686
See application file for complete search history.

(56) References Cited

U.S. PATENT DOCUMENTS

| | | | | | |
|---|---|---|---|---|---|
| 2,449,108 | A * | 9/1948 | Carlock | ..... | 83/387 |
| 3,033,065 | A * | 5/1962 | Fuller | ..... | 83/131 |
| 4,031,787 | A * | 6/1977 | Cady | ..... | 83/140 |
| RE29,958 | E * | 4/1979 | Cady | ..... | 83/140 |
| 4,261,237 | A * | 4/1981 | DiDonato et al. | ..... | 83/139 |
| 5,329,835 | A * | 7/1994 | Timp et al. | ..... | 83/686 |
| 5,701,790 | A * | 12/1997 | Saito | ..... | 83/140 |
| 5,839,341 | A * | 11/1998 | Johnson et al. | ..... | 83/530 |
| 5,884,546 | A * | 3/1999 | Johnson | ..... | 83/530 |
| 6,047,621 | A * | 4/2000 | Dries et al. | ..... | 83/136 |
| 6,152,005 | A * | 11/2000 | Ootsuka | ..... | 83/138 |
| 6,311,594 | B1 * | 11/2001 | Ootsuka | ..... | 83/138 |
| 7,156,009 | B2 * | 1/2007 | Iwamoto et al. | ..... | 83/686 |
| 7,168,356 | B2 * | 1/2007 | Rosene et al. | ..... | 83/686 |

(Continued)

FOREIGN PATENT DOCUMENTS

EP 1334782 8/2003

(Continued)

OTHER PUBLICATIONS

English Language Abstract of JP 2001-105053.

(Continued)

*Primary Examiner*—Kenneth E. Peterson
*Assistant Examiner*—Sean Michalski
(74) *Attorney, Agent, or Firm*—Greenblum & Bernstein P.L.C.

(57) ABSTRACT

An upper tool device includes: a punch body having a punch blade at a lower end of the punch body; a punch guide into which the punch body is fitted so as to be movable in vertical direction; an adjustment screw member provided above the punch guide, the adjustment screw member screwed with a screw formed on the punch body; a stripper unit including an urging unit urging the punch body in an upward direction; and a retainer collar including a stopper piece having a tip end disengageably engaged with a stopper formed on the punch body. In the device, the stripper unit is detachably provided in the upper tool device, and the retainer collar is provided between the punch guide and the stripper unit in a manner such that the retainer collar can be relatively rotated against the stripper unit.

7 Claims, 4 Drawing Sheets

U.S. PATENT DOCUMENTS

| | | | | |
|---|---|---|---|---|
| 7,658,134 | B2 * | 2/2010 | Morgan | 83/530 |
| 2004/0011178 | A1 | 1/2004 | Iwamoto et al. | |
| 2004/0045424 | A1 | 3/2004 | Ikeda et al. | |
| 2004/0074278 | A1 | 4/2004 | Hayashi et al. | |
| 2005/0220926 | A1 | 10/2005 | Naito et al. | |
| 2006/0060046 | A1 * | 3/2006 | Sugizaki et al. | 83/138 |

FOREIGN PATENT DOCUMENTS

| | | |
|---|---|---|
| JP | 6-304676 | 11/1994 |
| JP | 7-85816 | 9/1995 |
| JP | 7-314061 | 12/1995 |
| JP | 2001-105053 | 4/2001 |
| JP | 2002-205130 | 7/2002 |
| JP | 2003-266135 | 9/2003 |
| JP | 2005-246393 | 9/2005 |
| WO | 94/07663 | 4/1994 |

OTHER PUBLICATIONS

English Language Abstract of JP 7-314061.
English Language Abstract of JP 6-304676.
English Language Abstract of JP 2002-205130.
English Language Abstract of JP 2003-266135.
English Language Abstract of JP 2005-246393.
English language Abstract of JP 6-039459, Feb. 15, 1994.

* cited by examiner

UPPER TOOL DEVICE AND PUNCH THEREFOR

CROSS REFERENCE TO RELATED APPLICATION

This application is based upon and claims the benefit of priority from the prior Japanese Patent Application No. P2005-195092, filed on Jul. 4, 2005; the entire contents of which are incorporated herein by reference.

BACKGROUND OF THE INVENTION

1. Field of the Invention

The present invention relates to an upper tool device employed to be attached to a punch press such as a turret punch press and a punch employed in the upper tool device. More specifically, the invention relates to an upper tool device that can facilitate height adjustment.

2. Description of the Related Art

In a conventional upper tool device employed to be attached to a punch press, when a punch blade of the upper tool device is worn, the punch blade is reground. When the punch blade is reground, an entire length of the punch is reduced, and a height adjustment is consequently performed (for example, see Patent document: Japanese Patent Application Laid-open No. 2001-105053).

FIG. 1 shows a configuration of the upper tool device disclosed in the Patent document.

Namely, the conventional upper tool device includes a cylindrical punch guide 101. A punch body 105 that includes a punch blade 103 provided on a lower end thereof is fitted into the punch guide 101 so as to be movable in vertical direction. To restrict rotation of the punch body 105 relative to the punch guide 101, a key 109 provided on the punch body 105 is slidably engaged with a vertical key groove 107 formed in the punch guide 101.

A cylindrical spring collar 111 is detachably attached to an upper portion of the punch guide 101 through a pin 113. A lock member 115 is fixedly screwed with an upper portion of the spring collar 111. A punch head 117 is vertically supported by the lock member 115 so as to be movable in vertical direction, and a screw formed on an upper end of the punch body 105 is screwed with a female screw formed on this punch head 117 so that a vertical position of the punch body 105 is adjustable. A stripper spring 121 is elastically attached between an annular spring seat 119 abuttable with a lower end of the punch head 117 and a bottom of the spring collar 111.

To restrict rotation of the punch head 117 relative to the lock member 115, a vertical groove 123 is formed circumferentially and equidistantly in a plurality of portions on an outer peripheral surface of the punch head 117. A lock piece 127 of a lock unit 125 provided in the lock member 115 is provided to be disengageably engaged with the groove 123. Since a configuration of the lock unit 125 is publicly known, it will not be explained in detail.

With this configuration, while the lock piece 127 is engaged with the groove 123 of the punch head 117, the rotation of the punch head 117 relative to the lock unit 125 is restricted. Therefore, when a vertically movable striker (not shown) provided in a punch press presses the punch head 117, then the punch head 117 and the punch body 105 are moved downward against an urging force of the stopper spring 121, and a workpiece provided on a die (not shown) is punched.

When the punch head 117 is rotated while the lock piece 127 is disengaged from the groove 123 of the punch head 117, the position of the punch body 105 can be vertically adjusted since the rotation of the punch body 105 is restricted by the key 109. As explained above, the punch head 117 is rotated and fixedly screwing of the upper end of the punch body 105 with the punch head 117 is released, whereby the punch body 105 can be detached from the punch guide 101 in a downward direction and the punch blade 103 can be reground.

With the configuration of this conventional upper tool device, when the punch blade 103 is worn, the punch blade 103 can be reground by detaching the punch body 105 from the die assembly (upper tool device) without using a tool. In addition, the height adjustment can be performed.

The conventional upper tool device has, however, the following disadvantages. When the punch head 117 is rotated relative to the punch body 105, the engagement of the key 109 provided on the punch body 105 with the key groove 107 of the punch guide 101 can restrict the rotation of the punch body 105. Therefore, even if the punch blade 103 is, for example, circular to allow the rotation of the punch body 105, it is still necessary to provide the key and the key groove. The conventional upper tool device is, therefore, desired to be improved in facilitation of machining and simplification of the configuration.

Furthermore, with the configuration of the conventional upper tool device, the punch body is inserted into the punch guide from below and the upper end of the punch body is screwed with the punch head. This disadvantageously complicates an assembly operation. In addition, when the punch body is vertically adjusted, it is rather difficult to measure a length from an upper surface of the punch head to the punch blade.

SUMMARY OF THE INVENTION

The present invention has been achieved with such points in mind.

It therefore is an object of the present invention to provide an upper tool device and punch for the upper tool device which can facilitate height adjustment.

To achieve the object, according to a first aspect of the present invention, there is provided an upper tool device comprising: a punch body that has a punch blade provided on a lower end; a punch guide into which the punch body is vertically movably fitted; an adjustment screw member provided in an upper portion of the punch guide and screwed with a screw formed on the punch body; a stripper unit that includes an urging unit that urges the punch body in an upward direction; and a retainer collar that includes a stopper piece having a tip end disengageably engaged with a stopper formed on the punch body, wherein the stripper unit is detachably provided in the upper tool device, and the retainer collar is provided between the punch guide and the stripper unit so that relative rotation of the retainer collar can be fixed to the stripper unit.

According to a second aspect of the present invention, there is provided a punch used in an upper tool device, comprising: a punch body that has a punch blade provided on a tip end; and a punch driver smaller in diameter than the punch body, wherein a spring is provided on a tip end of the punch driver; and a groove-like stopper parallel to an axis of the punch driver is provided near a proximal portion of the punch driver.

According to a third aspect of the present invention, there is provided an upper tool device, comprising: a punch having a punch body and a punch driver located above the punch body, the punch body having a punch blade at a lower end of the punch body, the punch driver being formed with a screw portion at un upper portion of the punch driver, the punch driver being formed with a concave stopper at a lower portion of the punch driver, the stopper vertically extending; a punch head formed with another screw portion screwed with the screw portion of the punch driver so that the punch driver is fitted into the punch head; a spring seat into which the punch driver is fitted so as to be movable in vertical direction at an upper portion of the spring seat wherein the spring seat can not be relatively rotated around the axis thereof against the punch head; and a retainer collar into which a lower portion of the punch driver is vertically movably fitted wherein the spring seat is mounted on au upper surface of the retainer collar, the retainer collar having a stopper piece of which a tip end disengageably engaged with the stopper formed on the punch body, thereby the punch driver can be relatively rotated around the axis thereof against the retainer collar when the stopper piece is disengaged from the stopper, wherein the punch can be relatively rotated around the axis thereof against the punch head, the spring seat and the retainer collar when the stopper piece is disengaged from the stopper so that the screw portion formed on the punch head and the screw portion formed on the punch driver are disengaged, thereby the punch can be removed from the punch head, the spring seat and the retainer collar.

According to a fourth aspect of the present invention, there is provided an upper tool device, comprising: a punch guide; a punch fitted into the punch guide so as to be movable in vertical direction along an axis of the punch guide, the punch having a punch body and a punch driver located above the punch body, the punch body united with the punch driver, the punch body formed with a punch blade at a lower end of the punch body, the punch driver formed with a screw portion at un upper portion of the punch driver, the punch driver formed with a first concave stopper vertically extending at a lower portion of the punch driver; a punch head formed with another screw portion screwed with the screw portion of the punch driver so that the punch driver is fitted into the punch head; a spring seat into which the punch head is fitted at a lower portion of the punch head so as to be movable in vertical direction, the punch driver fitted into the spring seat at an upper portion of the spring seat, one of the spring seat and the punch head provided with a key groove vertically extending and the other one of the spring seat and the punch head provided with a key engaged with the key groove so as to arrest relative rotation between the spring seat and the punch head; a stripper spring provided between the punch head and the spring seat; a retainer collar provided under surface of the spring seat so as to surround a lower portion of the punch driver, the retainer collar provided with a first stopper piece movable in the radial direction of the axis of the punch wherein a tip end of the first stopper piece can be engaged with the first concave stopper when the first stopper piece moves inward in the radial direction, thereby the punch driver can be relatively rotated around the axis of the punch driver against the retainer collar when the first stopper piece is disengaged from the first concave stopper; a second concave stopper formed on the spring seat along a ring-shaped space of which a center is located in the axis of the punch; a second stopper piece movable in the radial direction of the axis of the punch wherein the second stopper piece can be engaged with the second concave stopper at outward position in the radial direction and the second stopper piece can be disengaged from the second concave stopper at inward position in the radial direction located in the ring-shaped space, thereby arresting relative rotation between the spring seat and the retainer collar, wherein the punch can be rotated around the axis thereof against the punch head, the spring seat and the retainer collar when the first stopper piece is disengaged from the first stopper so that the screw portion formed on the punch head and the screw portion formed on the punch driver are disengaged, thereby the punch can be removed from the punch head, the spring seat and the retainer collar; and wherein when the second stopper piece is disengaged from the second stopper, the retainer collar, the punch guide and the punch body are able to be relatively rotated around the axes thereof against the spring seat and the punch head, thereby relatively vertical position of the punch against the punch guide can be adjusted by lead between the screw portion formed on the punch head and the screw portion formed on the punch driver.

According the present invention, it is unnecessary to provide the key groove on the punch guide and the key engaged with the key groove on the punch body. It is, therefore, possible to facilitate machining and to simplify its configuration. Furthermore, the punch body can be fitted into the punch guide while the stripper unit, the retainer collar, and the punch body are assembled with one another in advance. It is, therefore, possible to facilitate assembly. Besides, even after the punch body is reground and adjusted, the length from the upper surface of the punch head to the punch blade on the tip end of the punch body can be accurately measured, and the height adjustment of the die can be accurately performed, accordingly.

BRIEF DESCRIPTION OF THE ACCOMPANYING DRAWINGS

DESCRIPTION OF THE PREFERRED EMBODIMENTS

There will be detailed below the preferred embodiments of an upper tool device and a punch employed in the upper tool device according to the present invention with reference to the accompanying drawings.

Figure 1:
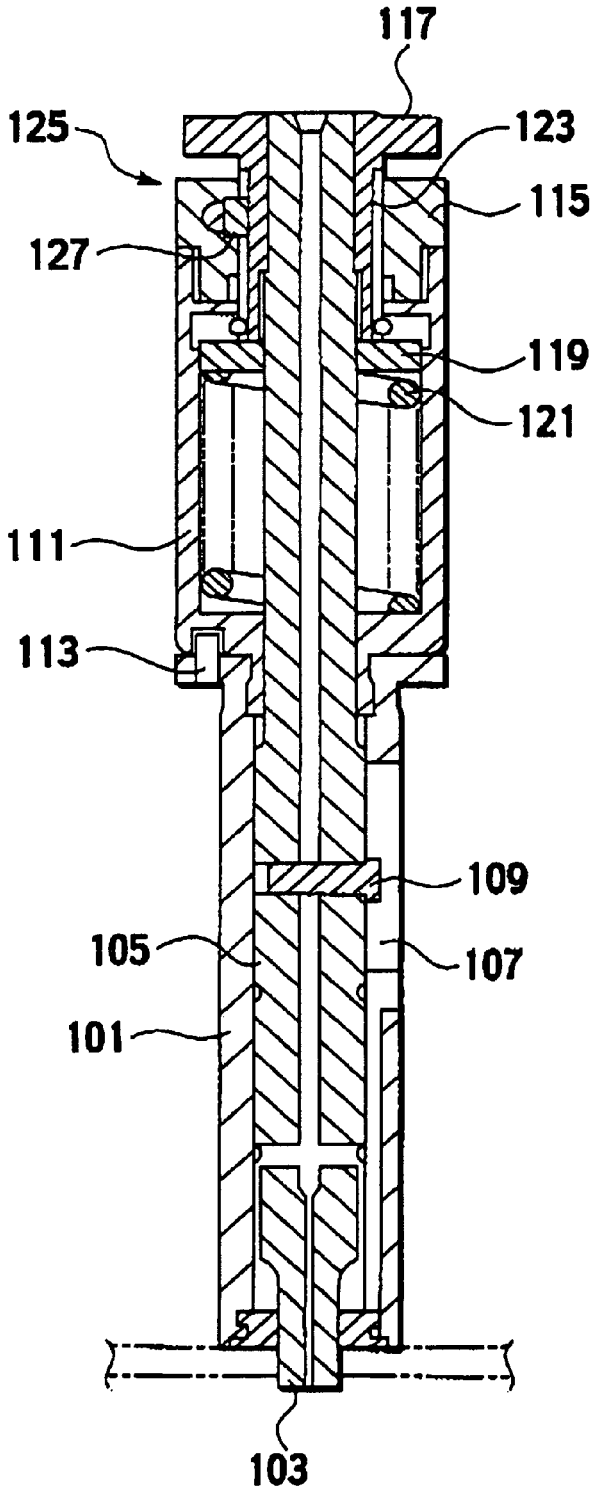
FIG.1 PRIOR ART
FIG. 1 is a cross-sectional explanatory view of a configuration of a conventional die assembly.
Figure 2:
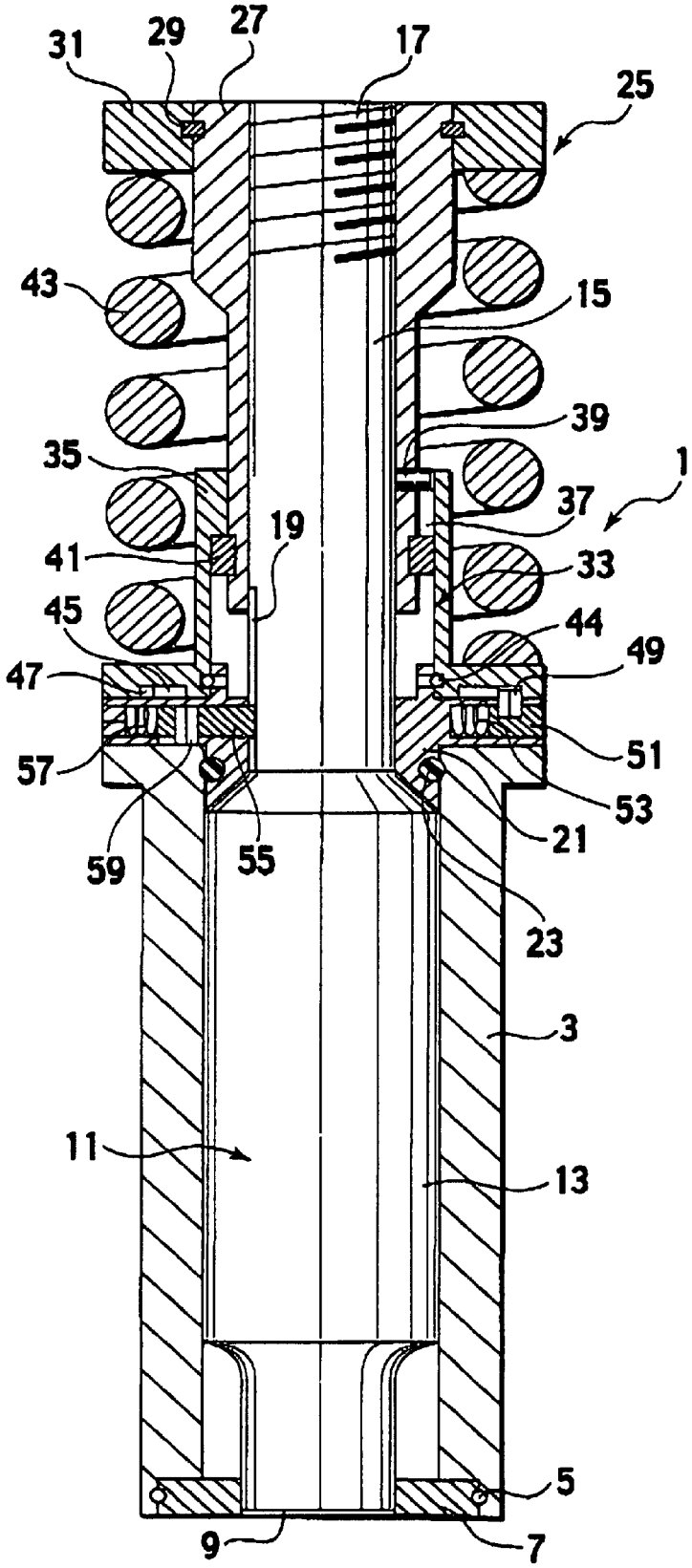
FIG. 2 is a cross-sectional explanatory view of a die assembly according to an embodiment of the present invention.

With reference to FIG. 2, an upper tool device (a die assembly) 1 according to an embodiment of the present invention includes a cylindrical punch guide 3. A stripper plate 7 is detachably attached to a lower end of the punch guide 3 through appropriate stoppers 5 such as O-rings. Alternatively, the stripper plate 7 can be formed integrally with the punch guide 3 in advance.

A punch 11 having a punch blade 9 provided on a lower end thereof is fitted into the punch guide 3 so as to be movable in vertical direction. The punch 11 is configured to include the punch blade 9 in a lower portion of a punch body 13 having a large diameter and slidably fitted into the punch guide 3. A punch driver 15 smaller in diameter than the punch body 13 is integrally provided with the punch body 13 in an upper portion thereof. A screw 17 is formed on a tip end of the punch driver 15, and a groove-like stopper 19 parallel to an axis of the punch driver 15 and having an appropriate length is formed on an outer circumferential surface of the punch driver 15 near a proximal portion thereof (at a position proximate to the punch body 13).

A retainer collar 21 is detachably attached to an upper portion of the punch guide 3 through appropriate stoppers 23 such as O-rings. A stripper unit 25 is attached to an upper portion of the retainer collar 21. In other words, the retainer collar 21 is provided between the punch guide 3 and the stripper unit 25.

The stripper unit 25 includes a punch head 27 that serves as an adjustment screw member including a female screw adjustably screwed with the screw 17 of the punch body 13. This punch head 27 is formed into a vertically elongated cylindrical shape, and a flange member 31 is integrally fixed to an upper end of the punch head 27 through fixtures 29 such as ring members.

A spring seat 33 is attached to a lower end of the punch head 27 so as to be movable in vertical direction without relatively rotating. A cylindrical portion 35 of the spring seat 33 is fitted into an outer circumference of a lower portion of the punch head 27 so as to be movable in vertical direction. A key 39 provided on the punch head 27 is engaged with a key groove 37 formed on the cylindrical portion 35 in a vertical direction. A detachment prevention ring 41 serving as a detachment prevention member is fixed to the outer circumferential surface of a lower end of the punch head 27. Appropriate elastic members 43 serving as urging units such as stripper springs are elastically attached between the flange member 31 and the spring seat 33.

The retainer collar 21 provided between the punch guide 3 and the stripper unit 25 is attached to the spring seat 33 through appropriate stoppers 44 such as O-rings so that the retainer collar 21 is detachable from the spring seat 33 and relative rotation of the retainer collar 21 to the spring seat 33 can be fixed. Namely, a circumferential groove 45 is formed on a lower surface of the spring seat 33 abutting on an upper portion of a flange of the retainer collar 21. A plurality of engagement recesses 47 in a diameter direction (radial direction) are provided equidistantly in an outer circumference of this circumferential groove 45.

The retainer collar 21 includes a slider 51 in a manner movable radially. The slider 51 includes pin-like lock pieces 49 engageable with the engagement recesses 47 and movable to positions on the circumferential groove 45, respectively. To maintain an engaging state of the engagement recesses 47 and the lock pieces 49, the slider 51 is always urged radially outward by an urging unit constituted by an elastic member 53 such as a coil spring provided in the retainer collar 21.

In an ordinary state, therefore, the lock pieces 49 are held while being engaged with the respective engagement recesses 47. When the slider 51 is pressed radially inward against the urging force of the elastic member 53, the lock pieces 49 are disengaged from the respective engagement recesses 47 and moved to the positions on the circumferential groove 45. In this embodiment, the instance where the circumferential groove 45 and the engagement recesses 47 are formed on the spring seat 33 and where the lock pieces 48 are provided on the retainer collar 21 has been explained. However, the positions at which the circumferential groove 45 and the lock pieces 49 are provided are relative. Therefore, the circumferential groove 45 and the engagement recesses 47 can be formed on the retainer collar 21 and the lock pieces 49 can be movably provided on the spring collar 33.

To restrict and arrest relative rotation (rotational movement) of the punch body 13 to the retainer collar 21, the retainer collar 21 includes a stopper piece 55 a tip end (an inner end) of which is disengageably engaged with the stopper 19 provided on the punch driver 15. The stopper piece 55 is movable radially. This stopper piece 55 is always urged radially inward by an elastic member 57 such as a coil spring provided as one example of the urging unit provided on the retainer collar 21.

In the ordinary state, therefore, the tip end of the stopper piece 55 is always engaged with the stopper 19 and the relative rotation of the punch body 13 to the retainer collar 21 is restricted. However, when an operation pin 59 provided on the stopper piece 55 is operated to move the stopper piece 55 radially outward against the urging force of the elastic member 57, then the tip end of the stopper piece 55 is detached from the stopper 19, and the punch body 13 can be relatively rotated to the retainer collar 21.

With this configuration, in the ordinary state shown in FIG. 2, the retainer collar 21 and the spring seat 33 are relatively unrotatable to each other, and the punch body 13 is relatively unrotatable to the retainer collar 21. When the die assembly 1 in this state is attached to a punch press (not shown) and the punch head 27 is pressed by a striker provided in the punch press so as to be movable in vertical direction as usual, the punch head 27 and the punch 11 are moved downward relative to the punch guide 3 against the urging force of the elastic members 43. When the striker (not shown) rises, the punch head 27 and the punch 11 are moved upward and returned by the urging force of the elastic members 43.

When the punch blade 9 of the punch 11 is worn and needs to be reground, the retainer collar 21 and the punch body 13 are integrally pulled out from the punch guide 3 so as to release attachment of the retainer collar 21 and the punch body 13 by the stoppers 23. Thereafter, in a state where engagement of the stopper piece 55 with the stopper 19 by the stopper piece 55 is released is held in the punch 11, the punch 11 is rotated in a direction in which the punch 11 is loosened relative to the retainer collar 21, the punch head 17, and the like. The screw of the punch head 27 is thereby disengaged from the screw 17 of the punch 11, so that the punch 11 can be detached from the screw head 27. The punch blade 9 can be, therefore, reground.

Thereafter, conversely from the above operation, the screw 17 of the punch 11 is screwed with the screw of the punch head 27, whereby the punch 11 can be integrated with the punch head 27. The tip end of the stopper 55 is stopped by the stopper 19 of the punch 11 to thereby integrate the retainer collar 21 with the punch 11 so as not to rotate relative to each other. If so, the slider 51 is moved inward and the state where the lock piece 49 is detached from the engagement recess 47 of the circumferential groove 45 is held. It is thereby possible to relatively rotate the spring seat 33, that is, the stripper unit 25 to the retainer collar 21.

Accordingly, the screwing position of the screw 17 of the punch 11 relative to the punch head 27 can be adjusted and, therefore, the height adjustment can be performed. At this time, when the punch 11 is pulled out from the punch guide 3, the length from the upper surface of the punch head 27 to the punch blade 9 can be accurately measured. As already understood, the height adjustment is performed by relatively rotating the spring seat 33 to the retainer collar 21. It is, therefore, possible to perform the height adjustment even while the punch body 13 is fitted into the punch guide 3.

As understood from above, the height adjustment can be performed by relatively rotating the spring seat 33 to the retainer collar 21. It is unnecessary to provide the key groove on the punch guide 3 and the key on the punch head 27. Accordingly, this can facilitate machining the punch guide 3 and the like and simplify the configuration of the upper tool device 1.

Furthermore, the punch 11 can be attached or detached to or from the punch head 27 while the spring seat 33 is assembled with the retainer collar 21 in advance. It is, therefore, possible to assemble the stripper unit 25 that includes the punch head 27 and the like with the retainer collar 21 and the punch 27. This can facilitate assembling the punch 11 with the punch head 27.

Figure 3:
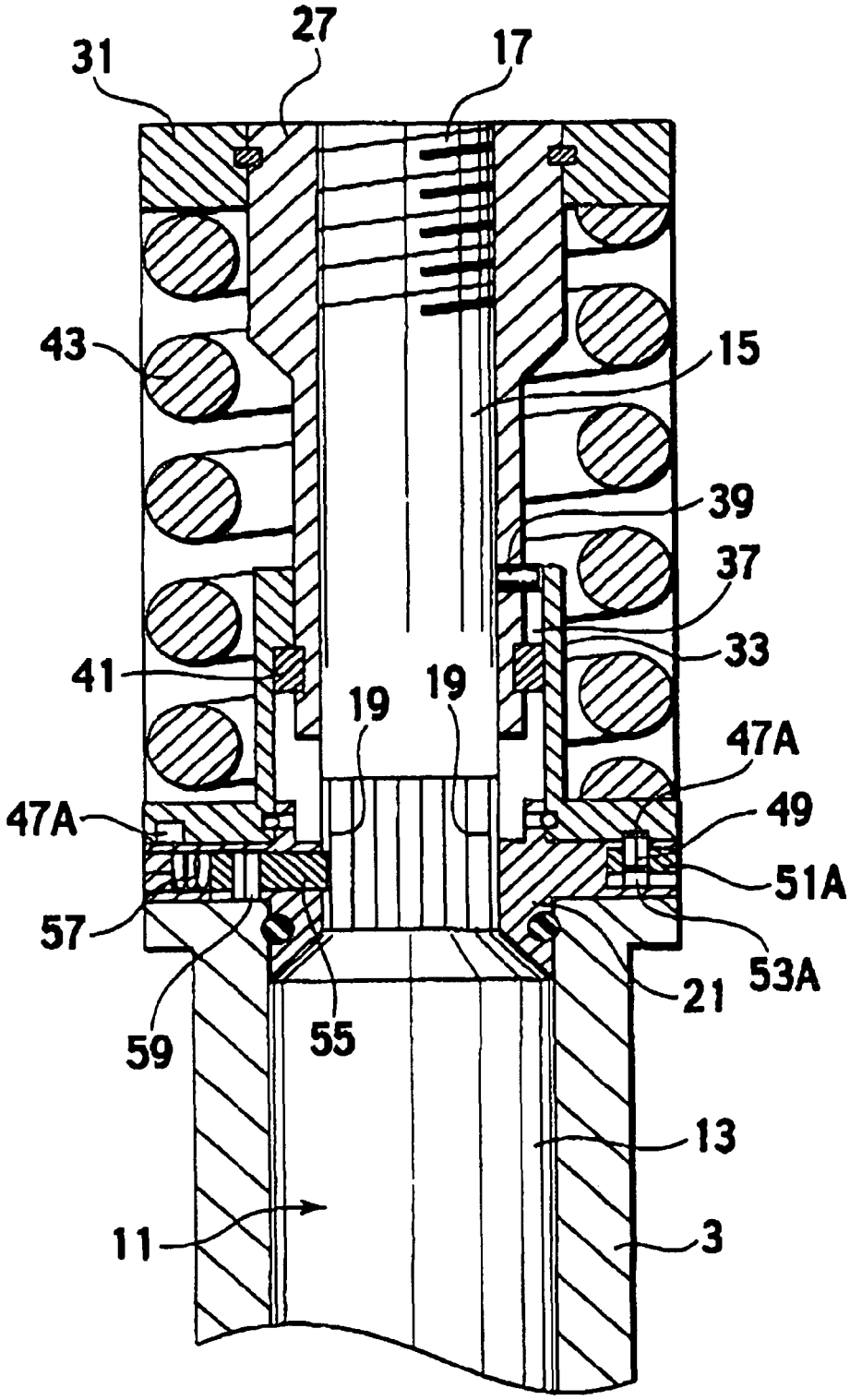
FIG. 3 is a cross-sectional explanatory view of relevant parts of a second embodiment of the invention.

The present invention is not limited to this embodiment but can be carried out in various manners by appropriately changing the invention. For example, as shown in FIG. 3, a plurality of stoppers 19 can be provided in a circumferential direction, that is, in the form of a serration. In addition, the lock piece 49 is provided on vertically movable upper and lower sliders 51A, and the upper and lower sliders 51A are always urged in an upward direction by an elastic member 53A provided in the retainer collar 21. Engagement recesses 47A with which the lock pieces 49 are disengageably engaged can be configured into a plurality of holes formed at appropriate intervals on a uniform circle on the lower surface of the spring seat 33.

Figure 4B:
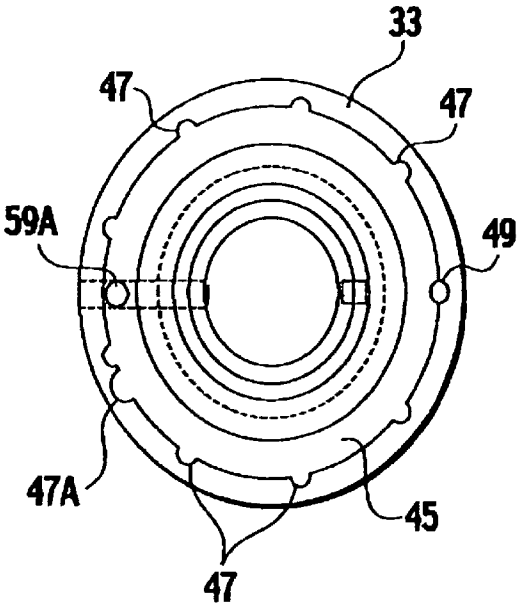
FIGS. 4A and 4B are cross-sectional explanatory views of relevant parts of a third embodiment of the invention.
Figure 4A:
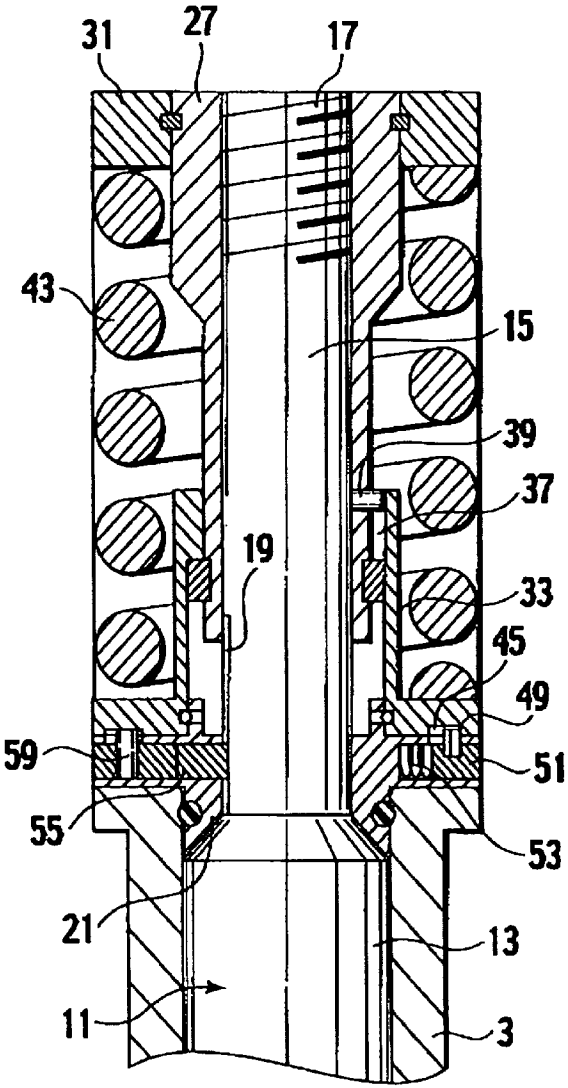

Alternatively, as shown in FIGS. 4A and 4B, the operation pin 59A provided on the stopper piece 55 is configured to protrude into the circumferential groove 45 of the spring seat 33. An engagement recess 47A which is larger than the engagement recesses 47 and with which the operation pin 59A is engageable is formed in this circumferential groove 45. With this configuration, when the spring seat 33 is relatively rotated to the retainer collar 21 to make the operation pin 59A correspond to the engagement recess 47A, the operation pin 59A can be engaged with the engagement recess 47A. In other words, various changes and modifications can be made to carry out the present invention in various manners.

While preferred embodiments of the present invention have been described using specific terms, such description is for illustrative purposes, and it is to be understood that changes and variations may be made without departing from the spirit or scope of the following claims.

What is claimed is:

1. An upper tool device, comprising:

a punch guide;

a punch body provided with a first screw portion at an upper end of the punch body, the punch body being fitted into the punch guide in a manner such that punch body is movable in a vertical direction;

a punch head provided with a second screw portion engaging with the first screw portion of the punch body so that the first screw portion of the punch body is screwably mounted in the punch head, the punch head having a flange member;

a spring seat into which the punch head is fitted in a manner such that the punch head is movable in a vertical direction, and a key member that prevents the punch head from rotating relative to the spring seat;

a retainer collar provided between the spring seat and the punch guide, the retainer collar including a stopper piece having a tip end disengageably engaged with a punch body stopper formed on the punch body restrict and arrest relative rotation of the punch body to the retainer collar;

the retainer collar is detachably attached to an upper portion of the punch guide; and an elastic member mounted between the punch head and the spring seat, wherein the punch head, the spring seat and the elastic member comprise a stripper unit; and the stripper unit being detachably mounted to the retainer collar so as to be detachable from the retainer collar when the first screw portion of the punch body is disengaged from the second screw portion provided on the punch head.

2. The upper tool device according to claim 1, further comprising:

an engagement recess provided in one of the spring seat and the retainer collar; and a lock piece provided in the other one of the spring seat and the retainer collar, the lock piece being movable in a radial direction of an axis of the upper tool device and configured to both engage and disengage from the engagement recess, thereby selectively preventing relative rotation between the spring seat and the retainer collar.

3. The upper tool device according to claim 2, wherein the engagement recess is provided in the spring seat; and the lock piece is provided in the retainer collar.

4. The upper tool device according to claim 2, wherein the engagement recess is provided in the retainer collar, and the lock piece is provided in the spring seat.

5. An upper tool device, comprising:

a punch body having a punch blade at a lower end of the punch body;

a punch guide into which the punch body is fitted so as to be movable in a vertical direction;

a stripper unit including: a spring seat, a punch head having a flange member, the punch head being fitted into the spring seat such that the punch head is movable in a vertical direction and non-rotatably connected to the spring seat, and an elastic member mounted between the punch head and the spring seat;

a retainer collar provided between the punch guide and the spring seat of the stripper unit, the retainer collar including a stopper piece having a tip end disengageably engaged with a punch body stopper formed on the punch body so as to restrict and arrest relative rotation of the punch body to the retainer collar, stripper unit stopper detachably mounting the stripper unit to the retainer collar;

the retainer collar can be rotated relative to the stripper unit; and a screw provided at an upper portion of the punch body, the screw engaging an adjustment screw portion provided on the punch head.

6. An upper tool device comprising:

a punch body having a punch blade at a lower end of the punch body and a punch driver at the upper end of the punch body, wherein the punch driver is provided with a first screw portion at an upper end;

a punch guide into which the punch body is fitted so as to be movable in a vertical direction;

an adjustment screw member including a punch head having a second screw portion, wherein the adjustment screw member is provided above the punch guide and engages the first screw portion of the punch driver;

a stripper unit having a radially outwardly extending flange located at an end thereof and attached to the outer circumference of the punch head, wherein a coil spring is positioned between a radially extending flange portion of a spring seat and the radially outwardly extending flange of the stripper unit such that the coil spring urges the punch body in an upward direction, wherein the stripper unit is detachably provided in the upper tool device, and one of the spring seat and the punch head is provided with a vertically extending key groove and the other one of the spring seat and the punch head is provided with a key engaged with the key groove so as to prevent relative rotation between the spring seat and the punch head;

a retainer collar including a stopper piece urged radially inward by an elastic member such that a radially inward end of the stopper piece disengageably engages a stopper groove provided on a lower portion of the punch driver, and the retainer collar is detachably attached to an upper portion of the punch guide;

a lock piece mounted in the retainer collar and configured to be engaged with a concave stopper provided on the spring seat in a manner such that relative rotation between the spring seat and the retainer collar is prevented, wherein disengagement of the lock piece from the stopper provided on the spring seat allows the retainer collar and the punch body to be relatively rotated with respect to the spring seat, the stripper unit and the punch head, thereby allowing a vertical position of the punch body to be adjusted by relative movement between the first and second screw portions; and the retainer collar is provided between the punch guide and the stripper unit.

7. An upper tool device comprising:

a punch guide;

a punch fitted into the punch guide so as to be movable in a vertical direction along an axis of the punch guide, the punch having a punch body and a punch driver located above the punch body, the punch body united with the punch driver, the punch body provided with a punch blade at a lower end of the punch body, the punch driver provided with a first screw portion at an upper portion of the punch driver, the punch driver provided with a first concave stopper vertically extending at a lower portion of the punch driver;

a punch head provided with a second screw portion engaging the first screw portion of the punch driver so that the punch driver is fitted into the punch head;

a spring seat into which the punch head is fitted so as to be movable in a vertical direction at a lower portion of the punch head, the punch driver fitted into the spring seat, one of the spring seat and the punch head provided with a key groove vertically extending and the other one of the spring seat and the punch head provided with a key engaged with the key groove so as to prevent relative rotation between the spring seat and the punch head;

a stripper spring provided between the punch head and the spring seat;

a retainer collar provided under a surface of the spring seat so as to surround a lower portion of the punch driver, the retainer collar provided with a first stopper piece movable in the radial direction of the axis of the punch wherein a tip end of the first stopper piece is configured to engage the first concave stopper when the first stopper piece moves inward in the radial direction, thereby allowing the punch driver to be relatively rotated with respect to the retainer collar when the first stopper piece is disengaged from the first concave stopper;

a second concave stopper provided on the spring seat along a ring-shaped portion; and a second stopper piece movable in the radial direction of the axis of the punch wherein the second stopper piece is configured to engage the second concave stopper at an outward position in the radial direction and the second stopper piece is configured to disengage from the second concave stopper at an inward position in the radial direction, thereby selectively preventing relative rotation between the spring seat and the retainer collar, wherein the punch is configured to be rotated relative to the punch head, the spring seat and the retainer collar when the first stopper piece is disengaged from the first concave stopper in a manner such that the second screw portion provided on the punch head and the first screw portion provided on the punch driver are disengaged, thereby allowing the punch to be removed from the punch head, the spring seat and the retainer collar, wherein disengagement of the second stopper piece from the second concave stopper allows the retainer collar, the punch guide and the punch body to be rotated relative to the spring seat and the punch head, thereby allowing the relative vertical position of the punch with respect to the punch guide to be adjusted by relative movement between the second screw portion provided on the punch head and the first screw portion provided on the punch driver.

* * * * *

UNITED STATES PATENT AND TRADEMARK OFFICE

CERTIFICATE OF CORRECTION

PATENT NO. : 7,802,506 B2
APPLICATION NO. : 11/266354
DATED : September 28, 2010
INVENTOR(S) : S. Endo et al.

It is certified that error appears in the above-identified patent and that said Letters Patent is hereby corrected as shown below:

At column 7, line 52 (claim 1, line 19) of the printed patent, insert --so as to-- before restrict.

Signed and Sealed this
Third Day of May, 2011

David J. Kappos

David J. Kappos
*Director of the United States Patent and Trademark Office*